US008188020B2

(12) United States Patent
Le Coent et al.

(10) Patent No.: US 8,188,020 B2
(45) Date of Patent: May 29, 2012

(54) LUBRICATING OIL COMPOSITION CONTAINING AN ALKALI METAL DETERGENT

(75) Inventors: Jean-Louis Le Coent, Le Havre (FR); Amedee Guellec, Saint-Sauveur D'emalleville (FR); Eugene E. Spala, Fairfield, CA (US)

(73) Assignee: Chevron Oronite S.A., San Ramon, CA (US)

( * ) Notice: Subject to any disclaimer, the term of this patent is extended or adjusted under 35 U.S.C. 154(b) by 246 days.

(21) Appl. No.: 10/744,871

(22) Filed: Dec. 22, 2003

(65) Prior Publication Data

US 2005/0137100 A1 Jun. 23, 2005

(51) Int. Cl.
*C07C 51/15* (2006.01)
*C10M 131/00* (2006.01)

(52) U.S. Cl. ..... 508/518; 508/502; 508/519

(58) Field of Classification Search ..... 508/518, 508/502, 501, 519, 523
See application file for complete search history.

(56) References Cited

U.S. PATENT DOCUMENTS

| | | | | |
|---|---|---|---|---|
| 4,032,555 | A | 6/1977 | Bottaccio et al. | |
| 5,030,687 | A | 7/1991 | Leone | |
| 5,119,780 | A * | 6/1992 | Ariga | 123/300 |
| 5,393,332 | A | 2/1995 | Saito et al. | |
| 5,449,470 | A | 9/1995 | Cahoon et al. | |
| 5,688,751 | A | 11/1997 | Cleveland et al. | |
| 5,895,777 | A | 4/1999 | Ueda et al. | |
| 7,053,027 | B2 * | 5/2006 | Chambard et al. | 508/460 |
| 7,148,186 | B2 * | 12/2006 | Kuribayashi et al. | 508/365 |

FOREIGN PATENT DOCUMENTS

| | | | |
|---|---|---|---|
| EP | 985726 | A1 * | 3/2000 |
| EP | 1 016 706 | A2 | 7/2000 |
| EP | 1059301 | A1 | 12/2000 |
| EP | 1154012 | A2 | 11/2001 |
| EP | 1 167 497 | A2 | 1/2002 |
| GB | 734 598 | | 8/1955 |
| GB | 734598 | | 8/1955 |
| GB | 734622 | | 8/1955 |
| GB | 738 359 | | 10/1955 |
| GB | 738359 | | 10/1955 |
| GB | 786167 | | 11/1957 |
| GB | 1146925 | | 3/1969 |
| WO | WO97/46644 | | 12/1997 |
| WO | WO97/46645 | | 12/1997 |
| WO | WO97/46647 | | 12/1997 |
| WO | WO99/28422 | | 6/1999 |

OTHER PUBLICATIONS

Search Report/Written Opinion dated Oct. 21, 2009 for corresponding Singapore Application No. 200705094-1 (all references previously cited in United States).
Lindsey et al., The Kolbe-Schmitt Reaction, Chem Rev. vol. 57, pp. 583-620, (1957).
Salicyclic Acid and Related Compounds, Kirk-Othmer Encyclopedia of Chemical Technology, 3rd Edition, vol. 20, pp. 500-524, 1982, John Wiley & Sons, New York.
Lubricants and Lubrication, edited by Theo Mang and Wilfried Dresel, 2001 Wiley-VCH BmbH, Weinheim, pp. 98-99.
Kosugi et al., Carboxylations of Alkali Metal Phenoxides with Carbon Dioxide, Org. Biomol. Chem., 2003, 1, pp. 817-821, The Royal Society of Chemistry.

* cited by examiner

*Primary Examiner* — Amy Lang
(74) *Attorney, Agent, or Firm* — Jones Day

(57) ABSTRACT

The present invention provides overbased detergents as lubricating additives effective for the lubrication of mechanical components in land and marine engines, such as, for example, hydraulic systems, transmissions, two-stroke and four-stroke vehicular engines, and trunk piston and two-stroke crosshead marine engines.

19 Claims, No Drawings

LUBRICATING OIL COMPOSITION CONTAINING AN ALKALI METAL DETERGENT

The present invention relates to detergents for lubricating oil applications. In particular, the present invention relates to a lubricating oil composition containing an alkali metal detergent effective for the lubrication of mechanical components in land and marine engines.

BACKGROUND OF THE INVENTION

Overbased detergents are well described to provide lubricating properties. Often such detergent additives are proportioned with other lubricating additives to provide lubricating oil compositions that exhibit certain desired lubricating properties. Overbased alkali or alkaline-earth metal sulfonates are examples.

European Patent Application Publication No. 1059301A1 describes alkaline-earth aralkylsulfonates having improved detergent and dispersant properties.

International Application WO 97/46644 describes a calcium overbased detergent comprising a surfactant system derived from at least two surfactants, in which at least one of the surfactants is a sulfurized or non-sulfurized phenol, or at least one other of the surfactants is other than a phenol, for example a sulfonic acid derivative, the proportion of phenol in the surfactant system being at least 35% by mass, and the TBN/% surfactant ratio of said detergent being at least 15.

International Application WO 97/46645 describes a calcium overbased detergent comprising a surfactant system derived from at least two surfactants in which at least one of the surfactants is a sulfurized or non-sulfurized phenol, or at least one other of the surfactants is a sulfurized or non-sulfurized salicylic acid, the total proportion of said phenol and of said salicylic acid in the surfactant system being at least 55% by mass, and the TBN/% surfactant ratio of said detergent being at least 11.

International Application WO 97/46647 describes a calcium overbased detergent comprising a surfactant system derived from at least two surfactants in which at least one of the surfactants is a sulfurized or non-sulfurized phenol, or at least one other of the surfactants is other than a phenol, for example an alkylarylsulfonate, the proportion of phenol in the surfactant system being at least 15% by mass, and the TBN/% surfactant ratio of said detergent being at least 21.

International Application WO 99/28422 describes a lubricating oil composition comprising a mixture of at least two detergents containing metals, namely, a) a phenate, sulfonate, salicylate, naphthenate or metal carboxylate, and b) an overbased calcic detergent comprising a surfactant system derived from at least two surfactants in which at least one of the surfactants is a sulfurized or non-sulfurized phenol, or at least one other surfactant is other than a phenol, the proportion of phenol in the surfactant system being at least 45% by mass, and the TBN/% surfactant ratio of said detergent being at least 14.

Alkaline-earth metal hydroxybenzoates are also known as additives for engine lubricating oils.

U.S. Pat. No. 5,895,777 describes lubricating oil additives comprising the alkaline-earth metal salts of aromatic carboxylic hydroxy acids containing carboxylic acids having 16 to 36 carbon atoms.

European Patent Application No. 1,154,012 describes lubricating compositions comprising an oil, an anti-wear additive and a sole oil-soluble overbased detergent comprising an aromatic carboxylate, such as a calcium salicylate substituted by a hydrocarbon remainder.

British Patent No. 1,146,925 describes lubricating compositions comprising, as lubricating agents, polyvalent metal salts, in particular calcium, and alkylsalicylic acids comprising more than 12, preferably 14 to 18 carbon atoms in the alkyl group. These salts can be prepared from the corresponding sodium salts, as synthesis intermediates.

British Patent No. 786,167 describes polyvalent metal salts of oil-soluble organic acids, such as sulfonic hydrocarbons, naphthenic acids or alkylhydroxybenzoic acids, in particular alkylsalicylic acids having an alkyl radical of up to 22 carbon atoms. The alkylsalicylic acids can be prepared from sodium alkylsalicylic acids according to the processes described in British Patents Nos. 734,598; 734,622 and 738,359. The sodium alkylsalicylates described in these British patents are useful as synthetic intermediates for the preparation of alkaline-earth alkylsalicylates, which are also useful as additives for lubricating oil.

In general, the above references describe preparation processes for aromatic carboxylic hydroxy acids and their salts which are derived from alkaline salts of phenol derivatives, such as phenol itself, cresols, mono- and dialkylphenols, the alkyl group having from about 8 to 18 carbon atoms, halogenated phenols, aminophenols, nitrophenols, 1-naphthol, 2-naphthol, halogenated naphthols, and the like.

SUMMARY OF THE INVENTION

The present invention relates to a lubricating oil composition. More particularly, the present invention relates to a lubricating oil composition containing an alkali metal detergent effective for the lubrication of mechanical components in land and marine engines, such as, for example, hydraulic systems, transmissions, two-stroke and four-stroke vehicular engines, trunk piston and two stroke crosshead marine engines. Accordingly, the present invention relates to a lubricating oil composition comprising a major amount of a base oil of lubricating viscosity and a minor amount of an additive concentrate comprising an organic liquid diluent and at least one oil-soluble additive comprising a compound having the general formula (I):

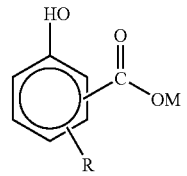

(I)

or a sulfurized derivative thereof, wherein:

R is an aliphatic group having from about 9 to 160 carbon atoms;

M is an alkali metal selected from the group consisting of lithium, sodium and potassium; and wherein the TBN of the additive concentrate is less than 100 and wherein the concentration of alkali metal in the additive concentrate is greater than 1500 ppm by weight.

In formula (I) above, R may be a linear or a branched aliphatic group, such as alkyl, or a mixture of linear and branched aliphatic groups. When R is a linear alkyl group, the linear alkyl group may typically have from about 20 to 40 carbon atoms. When R is a branched alkyl group, the branched alkyl group may typically have from about 9 to 40 carbon atoms. When M is sodium and R is a linear alkyl group, then R will preferably contain more than 22 carbon atoms.

M is preferably potassium.

The oil-soluble additive of the lubricating oil composition when employed in the present invention may be sulfurized and may comprise at least 80 wt % alkylhydroxybenzoate.

The present invention also relates to a method of lubricating an internal combustion engine by operating the internal combustion engine with the lubricating oil composition of the present invention. The lubricating oil composition is useful as an engine lubricant in, for example, two-stroke crosshead engines or a marine engine such as a trunk-piston type marine engine.

Among other factors, the present invention is based on the surprising discovery that a lubricating oil composition containing certain alkali metal detergents exhibit improved lubricating properties. Specifically, the lubricating oil composition of the present invention provides improved thermal stability and black sludge deposit control. The present invention has a wide variety of applications useful for the lubrication of mechanical components in land and marine engines, such as, for example, hydraulic systems, transmissions, two-stroke and four-stroke vehicular engines, trunk-piston and two-stroke crosshead marine engines.

DETAILED DESCRIPTION OF THE INVENTION

Prior to discussing the present invention in detail, the following terms will have the following meanings unless expressly stated to the contrary.

Definitions

The term "alkaline-earth metal" refers to calcium, barium, magnesium and strontium.

The term "alkali or alkaline metal" refers to lithium, sodium or potassium.

The term "aryl group" is a substituted or non-substituted aromatic group, such as a phenyl, tolyl, xylyl, ethylphenyl and cumenyl radical.

The term "hydrocarbyl" refers to an alkyl or alkenyl group.

The term "Total Base Number" or "TBN" refers to the equivalent number of milligrams of KOH needed to neutralize 1 gram of a product. Therefore, a high TBN reflects strongly overbased products and, as a result, a higher base reserve for neutralizing acids. The TBN of a product can be determined by ASTM Standard No. D2896 or equivalent procedure.

Lubricating Oil Composition

The present invention relates to a lubricating oil composition comprising a major amount of a base oil of lubricating viscosity and a minor amount an additive concentrate comprising an organic liquid diluent and an oil-soluble additive comprising a compound having the general formula (I):

(I)

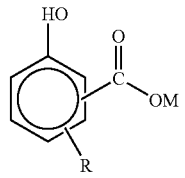

or a sulfurized derivative thereof, wherein:

R is an aliphatic group having from about 9 to 160 carbon atoms;

M is an alkali metal selected from the group consisting of lithium, sodium and potassium; and wherein the TBN of the additive concentrate is less than 100 and wherein the concentration of alkali metal in the additive concentrate is greater than 1500 ppm by weight.

The oil-soluble additive of the lubricating oil composition when employed in the present invention may be sulfurized and may comprise at least 80 wt % alkylhydroxybenzoate.

The sulfurized derivative of the oil-soluble additive may be obtained either by adding sulfur at the neutralization step of alkylphenol before carboxylation under pressure to give the alkylhydroxybenzoate or by adding sulfur on the alkylhydroxybenzoate itself, after carboxylation. The sulfurization step is conducted at a temperature higher than 145° C., preferably higher than 165° C. The rate of the sulfurization reaction may be improved by adding a monoalcohol or a diol having from about 1 to 6 carbon atoms such as methanol or a diol such as glycol.

The lubricating oil composition of the present invention containing the alkali metal-containing additive makes it possible to increase the high temperature stability of the lubricating oil composition as well as reduce deposits and provide improved dispersing power to the lubricating oil composition.

The lubricating composition of the invention can more particularly be used for the lubrication of engines, such as diesel or gasoline engines, whether these engines are two stroke or four stroke. They are particularly suitable for land vehicle engines (tractors, trucks, cars) and, preferably, marine engines, such as two-stroke crosshead marine (Marine Cylinder Lubricant) engines or so-called trunk piston engine oil (TPEO) engines, i.e. semi-rapid four-stroke engines, operating with heavy fuel.

Base Oil of Lubricating Viscosity

The base oil of lubricating viscosity employed in the present invention may be mineral oils or synthetic oils. A base oil having a viscosity of at least 10 cSt ($mm^2/s$) at 40° C. and a pour point below 20° C., preferably at or below 0° C. is desirable. The base oils may be derived from synthetic or natural sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene or higher alpha olefins (polyalphaolefin or PAO), or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful. For example, blends of 10 wt % to 25 wt % hydrogenated 1-decene trimer with 75 wt % to 90 wt % 150 SUS (100° F.) mineral oil make excellent lubricating oil bases.

Typically, the additive concentrate employed in the lubricating oil composition of the present invention will range from about 1 wt % to 45 wt %; preferably, from about 1 wt % to 30 wt %; more preferably, from about 5 wt % to 30 wt %, based on the total weight of the lubricating oil composition.

In the lubricating oil composition of the present invention, the concentration of the oil-soluble additive itself will generally range from about 0.1 wt % to 40 wt %; preferably, from about 0.1 wt % to 30 wt %; more preferably, from about 0.5 wt % to 25 wt %, based on the total weight of the lubricating oil composition.

Additive Concentrate

As discussed previously, the additive concentrate employed in the present invention comprises an organic liquid diluent and at least one oil-soluble additive comprising a compound having the general formula (I):

(I)

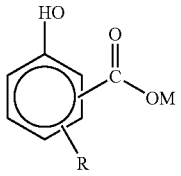

or a sulfurized derivative thereof, wherein:

R is an aliphatic group having from about 9 to 160 carbon atoms;

M is an alkali metal selected from the group consisting of lithium, sodium and potassium; and wherein the TBN of the additive concentrate is less than 100 and wherein the concentration of alkali metal in the additive concentrate is greater than 1500 ppm by weight.

In formula (I) above, R may be a linear or a branched aliphatic group, or a mixture of linear and branched aliphatic groups. Preferably, R may be an alkenyl or alkyl group. More preferably, R is an alkyl group.

When R is a linear aliphatic radical, it typically comprises from about 20 to 40, preferably from about 22 to 40 carbon atoms, and more preferably from about 20 to 30 carbon atoms.

When R is a branched aliphatic radical, it typically comprises from about 9 to 40 carbon atoms, and more preferably, from about 12 to 20 carbon atoms.

R can be obtained by oligomerization of propylene or butene.

R can also represent a mixture of linear or branched aliphatic radicals, identical or different. Preferably, R represents a mixture of linear, containing from about 20 to 30 carbon atoms, and branched, containing about 12 carbon atoms, alkyl radicals.

When R represents a mixture of aliphatic radicals, the oil-soluble additive employed in the present invention comprises an alkali metal alkylhydroxybenzoic acid of formula (I), having both linear or branched, identical or different, aliphatic radicals. R can be a mixture of linear aliphatic radicals, preferably alkyl, for example mixtures of $C_{14}$-$C_{16}$, $C_{16}$-$C_{18}$, $C_{18}$-$C_{30}$, $C_{20}$-$C_{22}$, $C_{20}$-$C_{24}$ or $C_{20}$-$C_{28}$ linear alkyl radicals. Advantageously, these mixtures include at least 95%, preferably 98% molar of alkyl groups.

The oil-soluble additive employed in the present invention, wherein R represents a mixture of alkyl radicals, can be prepared from linear alpha olefin cuts, such as those marketed by Chevron Phillips Chemical Company (CPC) under the names Alpha Olefin $C_{26}$-$C_{28}$ or Alpha Olefin $C_{20}$-$C_{24}$, by British Petroleum Corporation under the name $C_{20}$-$C_{28}$ Olefin®, by Shell Chimie under the name SHOP C20-22®, or also mixtures of these cuts.

The —COOM group of formula (I) can be in the ortho, meta or para position with respect to the hydroxyl group.

M is an alkali metal selected from the group consisting of lithium, sodium and potassium. Preferably, M is potassium. When M is sodium and R is a linear alkyl group, then R will preferably contain more than 22 carbon atoms.

The oil-soluble additive employed in the present invention is generally soluble in oil as characterized by the following test.

A mixture of a 600N oil and the additive at a content of 10% by weight with respect to the total weight of the mixture is centrifuged at a temperature of 60° C. and for 30 minutes, the centrifugation being carried out under the conditions stipulated by the standard ASTM D2273 (it should be noted that centrifugation is carried out without dilution, i.e. without adding solvent); immediately after centrifugation, the volume of the deposit which forms is determined; if the deposit is less than 0.05% v/v (volume of the deposit with respect to the volume of the mixture), the product is considered as soluble in oil.

Advantageously, the TBN of the additive concentrate employed in the present invention is lower than 100, preferably from about 10 to below 100.

Preferably, the concentration of alkali metal in the additive concentrate is greater than 2500 ppm by weight, more preferably greater than 5000 ppm by weight.

The sulfurized derivative of the oil-soluble additive may be obtained either by adding sulfur at the neutralization step of alkylphenol before carboxylation under pressure to give the alkylhydroxybenzoate or by adding sulfur on the alkylhydroxybenzoate itself, after carboxylation. The sulfurization step is conducted at a temperature higher than 145° C., preferably higher than 165° C. The rate of the sulfurization reaction may be improved by adding a monoalcohol or a diol having from about 1 to 6 carbon atoms such as methanol or a diol such as glycol.

The additive concentrate employed in the lubricating oil composition of the present invention is useful for lubricating an internal combustion engine when the engine is operated with the lubricating oil composition of the present invention. Adding an effective amount of the additive concentrate of the present invention to a lubricating oil improves the detergency of that lubricating oil in automotive diesel and gasoline engines, as well as in marine engine applications. Such compositions are frequently used in combination with Group II metal detergents, and other additives.

Lubricating marine engines with an effective amount of lubricating oil having the additive concentrate of the present invention can control black sludge deposits. It also improves the high temperature deposit control performance and demulsibility performance of that lubricating oil in marine applications.

Moreover, adding an effective amount of the additive concentrate employed in the present invention to a lubricating oil improves the high temperature deposit control performance, corrosion control and the oxidation inhibition performance of that lubricating oil in automotive applications.

Concentrate Formulation

The additive concentrates of the present invention will typically contain a sufficient amount of an organic liquid diluent and the oil-soluble additive employed in the present invention.

The concentrates contain sufficient organic liquid diluent to make them easy to handle during shipping and storage. Typically, the concentrate will contain from about 10 wt % to 90 wt %; preferably, from about 20 wt % to 70 wt %; and more preferably, from about 20 wt % to 35 wt %, of a compatible organic liquid diluent.

Suitable organic liquid diluents which can be used include, for example, solvent refined 100N, i.e., Cit-Con 100N, and hydrotreated 100N, i.e., Chevron 100N, and the like. The organic liquid diluent preferably has a viscosity of from about 1 to 20 cSt at 100° C.

From about 10 wt % to 90 wt %; preferably, from about 30 wt % to 80 wt % of the concentrate is the oil-soluble additive employed in the present invention.

Other Additive Components

Besides the additive concentrate employed in the present invention, the lubricating oil composition may also comprise other additives described below. These additional components can be blended in any order and can be blended as combinations of components. The lubricating oil composition produced by blending the above components might be a slightly different composition than the initial mixture because the components may interact.

The following additive components are examples of components that can be favorably employed in combination with the additive concentrate employed in the present invention. These examples of additives are provided to illustrate the present invention, but they are not intended to limit it.

(A) Ashless dispersants: alkenyl succinimides, alkenyl succinimides modified with other organic compounds, and alkenyl succinimides modified with boric acid, alkenyl succinic ester.

(B) Oxidation inhibitors:

1) Phenol type phenolic) oxidation inhibitors: 4,4'-methylenebis (2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis (3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl4-methylphenol, 2,6-di-tert-butyl4-ethylphenol, 2,4-dimethyl-6-tert-butyl-phenol, 2,6-di-tert-α-dimethylamino-p-cresol, 2,6-di-tert-4(N.N' dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl4-hydroxybenzyl).

2) Diphenylamine type oxidation inhibitor: alkylated diphenylamine, phenyl-α-naphthylamine, and alkylated α-naphthylamine.

3) Other types: metal dithiocarbamate (e.g., zinc dithiocarbamate), and methylenebis (dibutyidithiocarbamate).

(C) Rust inhibitors (Anti-rust agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate.

2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

(D) Demulsifiers: addition product of alkylphenol and ethylene oxide, polyoxyethylene alkyl ether, and polyoxyethylene sorbitane ester.

(E) Extreme pressure agents (EP agents): zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(F) Friction modifiers: fatty alcohol, fatty acid, amine, borated ester, and other esters (G) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound (H) Viscosity Index improvers: polymethacrylate type polymers, ethylene-propylene copolymers, styrene-isoprene copolymers, hydrated styrene-isoprene copolymers, polyisobutylene, and dispersant type viscosity index improvers.

(I) Pour point depressants: polymethyl methacrylate.

(K) Foam Inhibitors: alkyl methacrylate polymers and dimethyl silicone polymers.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Process for the Preparation of a Potassium Alkylhydroxybenzoate

Example 1

1. Neutralization Step 1200 g of alkylphenol wherein the alkyl group is derived from a mixture of $C_{20}$-$C_{28}$ linear alpha olefins, available from Chevron Phillips Chemical Company (CPC) and 632 g of ethylhexanol were charged with stirring into a four-necked reactor under vacuum.

The reaction mixture was heated from ambient temperature to 95° C. over 25 minutes under $10^5$ Pa (absolute pressure), then 311.8 g of an aqueous solution with 50 wt % of potassium hydroxide was introduced. The mixture was then taken to a temperature of 195° C. over 3 hours 30 minutes. As purity of KOH is 86.4 wt % and water: 50 wt %; effective quantity of KOH is: 311.8×0.5×0.864=134.7 g [which corresponds to a CMR (KOH/alkylphenol)=0.9]. Heating was continued progressively until reflex temperature was reached at 210° C., at which the temperature was maintained for 2 hours.

The temperature was then allowed to drop to 195° C. while reducing the vacuum to $4\times10^3$ Pa in order to distill the solvents. This temperature and pressure was maintained for 30 minutes with continued stirring at 600 rpm.

At the end of the distillation operation, 554.2 g of a 100N dilution oil, having a viscosity of 100 SUS at 37.8° C., was slowly added. When the temperature reached 170° C., the vacuum was discontinued with nitrogen purging while continuing to add dilution oil.

2. Carboxylation Step

The mixture resulting from the neutralization step described above was introduced into a stainless steel reactor with stirring under vacuum pressure.

Carbon dioxide under a pressure of $3.5\times10^5$ Pa was then introduced into the reactor at a temperature of 125° C. to 130° C. over 6 hours. The potassium alkylhydroxybenzoate (alkylsalicylate) was recovered having a $C_{20}$-$C_{28}$ alkyl chain along with unreacted alkylphenol and potassium alkylphenate.

Example 2

Example 2 was prepared according to Example 1 except a higher charge molar ratio KOH/alkylphenol (=1) is utilized instead of 0.9 in Example 1 at the neutralization step, to determine the influence of such a higher CMR on performance.

Example 3

Example 3 was prepared according to Example 1, except a lower charge molar ratio KOH/alkylphenol (=0.8) is utilized instead of 0.9 in Example 1 at the neutralization step, to determine the influence of such a lower CMR on performance.

Example 4

Example 4 was prepared according to Example 1 except the starting alkylphenols used in this example were prepared from a 50/50 mixture (by weight) of a $C_{20}$-$C_{28}$ linear alpha olefin mixture, available from Chevron Phillips Chemical Company (CPC) and a $C_{20}$-$C_{28}$ linear alpha olefin mixture, available from British Petroleum Company (BP).

Example 5

Example 5 was prepared according to Example 1 except that at the end of the neutralization step, 30 wt % of the 100N dilution oil was replaced with 10 wt % of 100N dilution oil and 20 wt % of a natural calcium sulfonate, marketed by the Lockart Company under the name Lockart Sulfonate 6941®. The TBN of the natural calcium sulfonate was 6.

Example 6

Example 6 was prepared according to Example 1 except the starting alkylphenols used in this example were prepared from a 50/50 mixture (by weight) of a $C_{20}$-$C_{28}$ linear alpha olefin mixture, available from Chevron Phillips Chemical Company (CPC) and a $C_{20}$-$C_{28}$ linear alpha olefin mixture, available from British Petroleum Company (BP).

Example 7

Example 7 was prepared according to Example 1 except the starting alkylphenols used in this example were prepared from a 70/30 mixture (by weight), respectively, of a $C_{20}$-$C_{28}$ linear alpha olefin mixture, available from Chevron Phillips Chemical Company (CPC) and a $C_{12}$ branched chain olefin.

The loads or quantity of reagents used to carry out Examples 1 to 7 are summarized in Table 1, as well as the contents of the main components of the product resulting from the carboxylation step. The results of the analysis of the alkylsalicylate prepared in Examples 1 to 7 are presented in Table 2.

TABLE 1

| | EXAMPLES | | | | | | |
|---|---|---|---|---|---|---|---|
| Reactant Charge | 1 | 2 | 3 | 4 | 5 | 6 | 7 |
| A. Neutralization Step | | | | | | | |
| Linear Alkylphenols (g) | 1200 | 1200 | 1200 | 600/600 | 1200 | 600/600 | 840/360 |
| CPC C20-C28 Olefin (%) | 100 | 100 | 100 | 50 | 100 | 50 | 70 |
| BP C20-C28 Olefin (%) | | | | 50 | | | |
| Branched C12 Alkylphenol | | | | | | 50 | 30 |
| Potassium Hydroxide (g) | 134.7 | 149.7 | 119.7 | 132.4 | 134.7 | 171.1 | 155.2 |
| KOH/Alkylphenol Molar Ratio | 0.9 | 1 | 0.8 | 0.9 | 0.9 | 0.9 | 0.9 |
| 2-Ethylhexanol (g) | 632 | 632 | 632 | 632 | 632 | 632 | 632 |
| 100 N Diluent Oil (g) | 554.5 | 558.9 | 550 | 553.8 | 184.8 | 184.8 | 560.6 |
| Lockart Sulfonate 6941 (g) | | | | | | 369.7 | |
| B. Carboxylation Step | | | | | | | |
| $CO_2$ Pressure (bar)[1] | 3.5 | 3.5 | 3.5 | 3.5 | 3.5 | 3.5 | 3.5 |
| Total Quality of Product (g) | 1850 | 1867 | 1835 | 1847 | 1850 | 1885 | 1870 |
| Total Surfactant (after dialysis)[2] (g) | 1231 | 1242 | 1221 | 1228.5 | 1322.6 | 1254 | 1244 |
| Alkylphenol/Total Surfactant[3] (wt/wt) | 0.13 | 0.13 | 0.13 | 0.13 | 0.115 | 0.21 | 0.16 |

TABLE 1-continued

| Reactant Charge | EXAMPLES 1 | 2 | 3 | 4 | 5 | 6 | 7 |
|---|---|---|---|---|---|---|---|
| Alkylphenol + Hydroxybenzoic acid/Total surfactant | 1.0 | 1.0 | 1.0 | 1.0 | 0.88 | 1.0 | 1.0 |
| Total Surfactant/Total composition (wt/wt) × 100 | 66 | 66 | 67 | 67 | 71.5 | 66 | 66 |
| TBN/% Total Surfactant | 1.0 | 1.1 | 0.90 | 1.03 | 0.95 | 1.35 | 1.14 |

[1]3.5 Bar is $3.5 \times 10^5$ Pa

[2]In order to eliminate the unreacted alkylphenols

[3]The alkylphenates, alkylhydroxybenzoates and sulfonates were measured in acid form: alkylphenols, alkylhydroxybenzoic acid and sulfonic acid. Thus, in Example 1, 13 % of the total surfactant is alkylphenate "phenol" and 87% is hydroxybenzoate.

TABLE 2

| Reactant Charge | EXAMPLES 1 | 2 | 3 | 4 | 5 | 6 | 7 |
|---|---|---|---|---|---|---|---|
| A. Neutralization Step | | | | | | | |
| Linear Alkylphenols (g) | | | | | | | |
| CPC C20-C28 Olefin (%) | 100 | 100 | 100 | 50 | 100 | 50 | 70 |
| BP C20-C28 Olefin (%) | | | | | | | |
| Branched C12 Alkylphenol | | | | 50 | | 50 | 30 |
| KOH/Alkylphenol Molar Ratio | 0.9 | 1 | 0.8 | 0.9 | 0.9 | 0.9 | 0.9 |
| 100 N Diluent Oil (%) | 30 | 30 | 30 | 30 | 10 | 30 | 30 |
| Lockart Sulfonate 69941 ® (%) | | | | | | 20 | |
| Sediments (vol. %) | 0.02 | 0.02 | 0.002 | 0.03 | 0.06 | 0.02 | 0.04 |
| TBN (mg KOH/g) | 70.9 | 76.5 | 63 | 68.8 | 71.5 | 89.4 | 78.6 |
| B. Carboxylation Step | | | | | | | |
| Potassium (%) | 4.69 | 5.15 | 4.28 | 4.64 | 4.52 | 5.36 | 4.8 |
| Calcium (%) | | | | | 0.32 | | |
| Sediments (vol. %) | 0.06 | 0.08 | 0.04 | 0.04 | 0.04 | 0.01 | 0.04 |
| TBN (mg KOH/gm)[1] | 65.7 | 72.2 | 60.0 | 65.7 | 68 | 84.5 | 75.4 |
| Salicyclic Index[1] | 61.5 | 62.8 | 54.7 | 51.0 | 50.5 | 66.4 | 63.0 |

[1]Measurement according to Standard ASTM D2896

Performance Testing and Results

The performance of the lubricating oil compositions was tested by using the following tests:

1. Hot Tube Test (I) Main Objective of the Test

The "Hot Tube Test" was designed to evaluate the detergency and the thermal stability of a lubricating oil composition by grading the coloring of a deposit formed in glass tubes heated to a high temperature.

(II) Implementation of the Test

A glass tube in which the oil circulates under a flow of air was placed in an oven heated to a high temperature. A lacquer appears on the wall of the tube because of the alteration of the lubricating oil additive.

The lacquer was graded by comparison with a reference color chart, ranging from 0 (black) to 10 (clean). When the detergent power is particularly poor, the glass tube blocks and becomes black (CLOGGED).

(III) Parameters of Implementation of the Test

| | |
|---|---|
| Duration of the test | 16 hrs |
| Sample of lubricating oil | 5 $cm^3$ |
| Flow of oil | 0.3 $cm^3$/hr |
| Flow of air | 10 $cm^3$/hr |
| Temperature: | 310° C. |

2. Dispersion Test with Heavy Fuel (I) Main Objective of the Test

To evaluate the dispersing and detergent credit or potential of a lubricating oil in marine engines consuming heavy fuel.

(II) Implementation of the Test

Sludge (soot particles) is introduced into a lubricating oil composition comprising a lubricating additive, previously polluted with heavy fuel and oxidized under an air flow and in the presence of a catalyst. Part of this mixture has added water and the other part is used as is. After stirring, each of the two mixtures (with and without water) is subjected to heat treatments carried out at three different temperatures. There are then six samples in total. A drop of each sample of contaminated lubricating oil composition is deposited on a filter paper and two concentric aureoles are formed, the outer one being the oil and the inner one comprising the lubricating additive. The diameters of the inner and outer aureoles obtained after 48 hours are measured for each of the six samples. A value of 100 is assigned to the diameter of the outer aureole and value proportional to its diameter is assigned to the inner aureole, for each sample. For example, if the ratio of inner aureole/outer aureole is 0.5, the value determined would be 0.5×100=50. The value determined for each internal aureole of the 6 samples is added together, and a value out of a total of 600 is obtained, corresponding to the lubricating additive's dispersing and detergent power; the higher the measured value out of 600, the higher the dispersing and detergent power. The formation of a deposit (FLOC, also called flocculation: no dispersion of the sludge) is also noted in place of the inner aureole, which corresponds to a poor dispersing and detergent power.

(III) Implementation Parameters for the Test (% by Weight)

| | |
|---|---|
| Sludge introduced | 20% |
| Heavy fuel introduced | 3% |
| Water introduced | 1% |
| Treatment temperature: | 20° C. |
| | 200° C. |
| | 250° C. |
| Pre-aging temperature | 175° C. |
| catalyst | iron naphthenate |
| Air flow | 15 l/h |
| Duration of the test | 48 hrs |

Formulations 1 to 7

Lubricating oil formulations prepared with the products from Examples 1 to 7 were examined in the Dispersion Test and Hot Tube Test, and a test for the appearance after one month at 80° C.

For the Dispersion Test and the Hot Tube Test, Examples 1 to 7 were formulated by admixture with the following components (% by weight) and designated as Formulations 1 to 7.

| | |
|---|---|
| polyisobutene bissuccinimide | 1.4% |
| zinc dithiophosphate | 0.66% |
| calcium $C_{20}$-$C_{24}$ alkylarylsulfonate TBN 425: | 7.06 wt % (to provide a total TBN of 30) |
| product of each of Examples 1 to 7 | sufficient to provide TBN 10 |

The quantity of the product of each of Examples 1 to 7 sufficient to provide a TBN of 10 is shown in Table 3.

| | |
|---|---|
| anti-foam agent | 40 ppm |
| 600 N base oil | sufficient to provide 100% |

The quantity of base oil required to reach 100% of the total formulation is shown in Table 3.

For the test of the appearance after one month at 80° C., Examples 1 to 7 were formulated by admixture with the following components (% by weight) and designated as Formulations 1 to 7.

| | |
|---|---|
| calcium $C_{20}$-$C_{24}$ alkylarylsulfonate TBN 425 | 10 wt % |
| product of one of Examples 1 to 7 | 10 wt % |
| 600 N dilution oil | 80 wt % |

Comparative Formulations A and B

Comparative Formulations A and B were also prepared using commercially available lubricating additives for comparison.

For the Dispersion Test and the Hot Tube Test, Comparative Formulation A was prepared as above in Formulations 1 to 7 except that the additive concentrate was replaced with additional calcium $C_{20}$-$C_{24}$ alkylarylsulfonate to give a total alkylarylsulfonate concentration of 9.41 wt % and a total TBN of 40. Performance of the product of each of Examples 1 to 7 was tested back to back versus alkylarylsulfonates.

For the Dispersion Test and the Hot Tube Test, Comparative Formulation B was prepared as above in Formulations 1 to 7 except the additive concentrate was replaced with 15.19 wt % of a calcium $C_{14}$-$C_{18}$ alkylarylsalicylate (providing a TBN of 10) to give a total TBN of 40 for the formulation. Performance of the product of each of Examples 1 to 7 was tested versus alkylarylsalicylate.

For the test of the appearance after one month at 80° C., formulations tested in the Dispersion and Hot Tube Tests in Table 3 were stored for one month in an oven at 80° C. At the end of the period, the formulations were cooled down at atmospheric pressure and rated as "liquid part/sediment part" as defined below:

Liquid part: Bright=1; Light cloud=2; Moderate cloud=3

Sediment part (if any): Absent=: 0; Light=1; Average=2; Considerable=3

1/0 means product clear/absence of sediment.

The results of these tests are shown in Table 3 below.

TABLE 3

| | Examples | | | | | | | Comparative Examples | |
|---|---|---|---|---|---|---|---|---|---|
| Formulation | 1 | 2 | 3 | 4 | 5 | 6 | 7 | A | B |
| Polybutene succinimide | 1.4% | 1.4% | 1.4% | 1.4% | 1.4% | 1.4% | 1.4% | 1.4% | 1.4% |
| Zinc dithiophosphate | 0.66% | 0.66% | 0.66% | 0.66% | 0.66% | 0.66% | 0.66% | 0.66% | 0.66% |
| Calcium C20-C24 alkylarylsulfonate, TBN 425 | 7.06% | 7.06% | 7.06% | 7.06% | 7.06% | 7.06% | 7.06% | 9.41% | 7.06% |
| Additive Concentrate | 14.91% | 13.57% | 16.33% | 14.91% | 14.41% | 11.60% | 13.0% | | |
| Calcium C14-C18 alkylarylsalicylate | | | | | | | | | 15.19% |
| Anti foam agent | 0.004% | 0.004% | 0.004% | 0.004% | 0.004% | 0.004% | 0.004% | 0.004% | 0.004% |
| 600 N Base oil | 75.97% | 77.31% | 74.55% | 75.97% | 76.47% | 79.28% | 77.88% | 88.53% | 75.69% |
| Dispersion Test | 396/600 | 390/600 | 400/600 | 399/600 | 396/600 | 375/600 | 400/600 | 300/600 | FLOC |
| 330° C. Hot Tube Test | 8.5 | 8.5 | 8.5 | 9 | 8.5 | 8 | 8 | Clogged | 8 |
| Appearance after one month at 80° C. in formulation | 1/0 | 1/0 | 1/0 | 1/0 | 1/0 | 1/0 | 1/0 | 1/0 | 1/3 |

The results in Table 3 show that Formulations 1-7 have a positive dispersing and detergency effect, as well as thermal stability greater than Comparative Formulations A and B.

What is claimed is:

1. A lubricating oil composition comprising:

a) a major amount of a base oil of lubricating viscosity and b) a minor amount of an additive concentrate comprising an organic liquid diluent and at least one oil-soluble additive comprising a compound having the general formula (I)

(I)

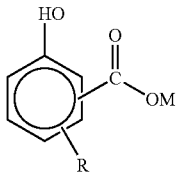

or a sulfurized derivative thereof, wherein:

R is an aliphatic group having from about 9 to 160 carbon atoms;

M is an alkali metal selected from the group consisting of lithium, sodium and potassium; and c) a dispersant effective amount of polybutene succinimide;

wherein the additive concentrate comprises:

i) a Total Base Number (TBN) from about 10 to less than 100; and ii) a concentration of alkali metal greater than 2500 ppm by weight.

2. The lubricating oil composition according to claim 1, wherein R is a linear or branched alkyl group or a mixture of linear and branched alkyl groups.

3. The lubricating oil composition according to claim 2, wherein R is linear alkyl group having from about 20 to 40 carbon atoms.

4. The lubricating oil composition according to claim 3, wherein R is a linear alkyl group having from greater than 22 up to 40 carbon atoms.

5. The lubricating oil composition according to claim 1, wherein R is selected from the group consisting of linear $C_{14}$-$C_{16}$, $C_{16}$-$C_{18}$, $C_{18}$-$C_{30}$, $C_{20}$-$C_{22}$, $C_{20}$-$C_{24}$ or $C_{20}$-$C_{28}$ alkyl or mixtures thereof.

6. The lubricating oil composition according to claim 2, wherein R is a branched alkyl group having from about 9 to 40 carbon atoms.

7. The lubricating oil composition according to claim 6, wherein R is a branched alkyl group having from about 12 to 20 carbon atoms.

8. The lubricating oil composition according to claim 1, wherein R is a mixture of linear and branched alkyl groups each containing 12 carbon atoms.

9. The lubricating oil composition according to claim 1, wherein M is potassium.

10. The lubricating oil composition according to claim 1, wherein the oil-soluble additive is sulfurized.

11. The lubricating oil composition according to claim 1, wherein the oil-soluble additive comprises at least 80 wt % alkylhydroxybenzoate.

12. The lubricating oil composition according to claim 1, wherein the concentration of alkali metal in the additive concentrate is greater than 5000 ppm by weight.

13. The lubricating oil composition according to claim 1, wherein M is sodium and R is a linear alkyl group containing more than 22 carbon atoms.

14. A method of lubricating an internal combustion engine, said method comprising operating the engine with the lubricating oil composition comprising:

a) a major amount of a base oil of lubricating viscosity and b) a minor amount of an additive concentrate comprising an organic liquid diluent and at least one oil-soluble additive comprising a compound having the general formula (I)

(I)

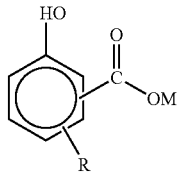

or a sulfurized derivative thereof, wherein:

R is an aliphatic group having from about 9 to 160 carbon atoms;

M is an alkali metal selected from the group consisting of lithium, sodium and potassium; and c) a dispersant effective amount of polybutene succinimide;

wherein the additive concentrate comprises:

i) a Total Base Number (TBN) from about 10 to less than 100; and ii) a concentration of alkali metal greater than 2500 ppm by weight.

15. The method according to claim 14, wherein the engine is a two-stroke crosshead engine or a marine engine.

16. The method according to claim 15 wherein the marine engine is a trunk-piston engine.

17. A lubricating oil composition comprising:

a) a major amount of a base oil of lubricating viscosity and b) a minor amount of an additive concentrate comprising an organic liquid diluent and at least one oil-soluble additive comprising a compound having the general formula (I)

(I)

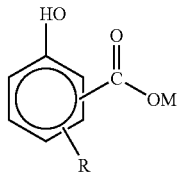

or a sulfurized derivative thereof, wherein:

R represents a linear aliphatic group having from 20 to 40 carbon atoms, a branched aliphatic group having from 9-40 carbon atoms, or a mixture of the linear and the branched alkyl groups;

M represents an alkali metal selected from the group consisting of lithium, sodium and potassium; and c) a dispersant effective amount of polybutene succinimide;

wherein the additive concentrate comprises:

i) a Total Base Number (TBN) from about 10 to less than 100; and ii) a concentration of alkali metal greater than 2500 ppm by weight.

18. The lubricating oil composition of claim 17, wherein R represents a mixture of linear $C_{20-28}$ alkyl groups and branched $C_{12}$ alkyl groups.

19. A method of lubricating an internal combustion engine, said method comprising operating the engine with the lubricating oil composition comprising:

a) a major amount of a base oil of lubricating viscosity and b) a minor amount of an additive concentrate comprising an organic liquid diluent and at least one oil-soluble additive comprising a compound having the general formula (I)

(I)

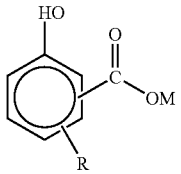

or a sulfurized derivative thereof, wherein:

R represents a linear aliphatic group having from 20 to 40 carbon atoms, a branched aliphatic group having from 9-40 carbon atoms, or a mixture of the linear and the branched alkyl groups;

M represents an alkali metal selected from the group consisting of lithium, sodium and potassium; and c) a dispersant effective amount of polybutene succinimide;

wherein the additive concentrate comprises:

i) a Total Base Number (TBN) from about 10 to less than 100; and ii) a concentration of alkali metal greater than 2500 ppm by weight.

* * * * *